United States Patent [19]

Bentz et al.

[11] Patent Number: 4,708,672

[45] Date of Patent: Nov. 24, 1987

[54] BOAT STABILIZER

[76] Inventors: L. Earl Bentz; Roark H. Summerford, both of 931 Industrial Rd., Old Hickory, Tenn. 37138

[21] Appl. No.: 854,402

[22] Filed: Apr. 18, 1986

[51] Int. Cl.[4] ..... B63H 25/48; B63H 5/16

[52] U.S. Cl. ..... 440/51; 440/66; 440/78

[58] Field of Search ..... 440/51, 66, 71, 76, 440/78, 49, 900; 114/285; 123/195 P

[56] References Cited

U.S. PATENT DOCUMENTS

| | | | |
|---|---|---|---|
| 2,564,903 | 8/1951 | Irgens | 115/17 |
| 2,860,594 | 11/1958 | Kiekhaefer | 115/17 |
| 3,516,378 | 6/1970 | Linsley | 440/51 X |
| 3,955,527 | 5/1976 | Holtermann | 115/35 |
| 3,980,035 | 9/1976 | Johansson | 114/66 |
| 4,205,618 | 6/1980 | Olsson | 440/66 X |
| 4,352,666 | 10/1982 | McGowan | 440/51 |
| 4,487,152 | 12/1984 | Larson | 114/274 |

*Primary Examiner*—Sherman D. Basinger
*Attorney, Agent, or Firm*—Luedeka & Neely

[57] ABSTRACT

A boat stabilizer is disclosed for substantially eliminating "porpoising" or up and down movement of the bow portion of a boat as the boat is moving through the water. The stabilizer includes a wedge-shaped member formed on an adjustably mounted trim tab located on the underside of an anti-cavitation plate of an outboard motor. The wedge-shaped member has a downwardly inclined lower surface extending generally laterally from and perpendicularly to a fin-shaped member of the trim tab. Movement of the boat through the water imparts a force against the downwardly inclined surface to effect a generally vertical torque on the boat substantially eliminating porpoising of the boat in a given speed range. The force imparted against the downwardly inclined surface is proportional to the angle of attack of the downwardly inclined surface so that upward displacement of the bow of the boat moving through the water is opposed by a proportionately greater force on the downwardly inclined surface. A number of stabilizers are provided with the angle of the downwardly inclined surface relative to the anti-cavitation plate being different for each stabilizer so that an appropriate stabilizer can be selected for different boat/outboard motor combinations.

10 Claims, 15 Drawing Figures

BOAT STABILIZER

FIELD OF THE INVENTION

The present invention relates to devices for stabilizing a boat moving on the surface of the water, and more particularly relates to a stabilizer adapted to substantially eliminate "porpoising" or up and down movement of the bow of the moving boat which occurs within a given speed range for a particular boat, and for providing adjustable control of stern drive steering torque.

BACKGROUND OF THE INVENTION AND PRIOR ART

Of the numerous problems which have plagued boat enthusiasts, perhaps the most troublesome is that of controlling the attitude angle of the boat as it is moving through the water. This problem becomes especially acute with the use of outboard motors at the stern portion of the boat which tend to induce greater upward displacement of the bow during forward motion. Usually, during the early stages of acceleration, the bow of a boat will be at a fairly high angle relative to the water surface because of the degree of hull contact with the water and displacement of water from beneath the stern portion of the boat caused by rotation of the propeller. As the boat continues to accelerate, the amount of the hull in contact with the water decreases until the desired speed is reached, where in many cases, such as very high speed boating, only a small portion of the hull surface will be in contact with the water. At intermediate speeds as the boat is accelerating, porpoising is often a problem due to the boat not having reached an equilibrium state. Porpoising is both uncomfortable and dangerous because during this period of instability, other normally insignificant instabilities can be catalyzed or can combine to upset the boat causing possible injury to the occupants. This phenomena also has a detrimental effect on performance due to slapping of the hull against the water which increases the frictional resistance to forward movement. Also, the plane of rotation of the propeller is altered in an undesirable manner causing a significant loss in efficiency. It has been found that porpoising can be a problem in speeds ranging from about 10 up to about 50 miles per hour. At higher speeds, most high performance boats reach a planing attitude angle with only a very small portion of the hull surface in contact with the water, and only the propeller portion of the outboard motor beneath the surface of the water.

Other problems resulting from the use of outboard motors relate to the attitude angle of the boat as it is moving through the water in a general sense, as distinguished from the porpoising problem. Various devices have been fashioned to create a lift at the stern portion of the boat to alter an otherwise undesirable attitude angle. These devices have generally involved altered designs for the lower drive unit of the outboard motor. One such device is disclosed in U.S. Pat. No. 4,487,152 to Larson which illustrates the use of an air foil-shaped stabilizer above the propeller to induce a lift at the stern portion of the boat. An attitude control device in the form of a wing or vane is also disclosed in U.S. Pat. No. 3,980,035 to Johansson which shows the vane positioned in the slip stream behind the propeller. Other developments involve forming the anti-cavitation plate with an inclined lower surface to preclude formation of low pressure areas into which air or exhaust gases can be sucked, and to exert a lift at the stern of the boat. A deflector has also been developed to create a high pressure area at the trailing edge of the anti-cavitation plate to improve trim tab effectiveness by forestalling the passage of air into the area of the trim tab, such as the device disclosed by Holterman in U.S. Pat. No. 3,955,527. Of the patents noted above, only Larson suggests a function of controlling porpoising by using an air foil-type stabilizer above the propeller in the position normally assumed by the anti-cavitation plate.

Another problem alluded to above has been addressed by the use of trim tabs. These devices are ordinarily designed to counteract steering torque, i.e., the tendency of the boat to rotate due to the torque applied by the rotating propeller in the water which results in an undesirable steering effect. In most modern outboard engines, the trim trap is located vertically above and rearwardly of the propeller and consists of a fin-shaped member projecting downwardly into the upper part of the slip stream following the propeller. A primary effect of the trim tab is to produce a torque in counteraction to the steering torque so that the boat responds in a balanced manner while making turns. Many such trim tabs are adjustably mounted to the lower surface of the anti-cavitation plate, usually by means of a disk-shaped support which can be rotated to alter the disposition of the trim tab depending on the boat style, water temperature, etc., to achieve the desired effect.

While the prior art includes trim tabs, inclined anti-cavitation plates, and various arrangements for inducing a lift at the rear of the boat, there exists a lack of a stabilizer which incorporates features adapted to address these various problems in a single, easily replaceable device of which a number can be manufactured having graduated sizes for custom fitting a boat to achieve optimum performance. While trim tabs have been easily replaceable, anti-cavitation plates have not. Thus, inclining the anti-cavitation plate or incorporating some other feature thereon to induce a lift at the rearward portion of the boat has been an essentially permanent modification to the outboard motor. This makes it difficult or impossible to switch motors from one boat to the other, as is the practice with many high speed boat enthusiasts.

Accordingly, there is a need for an easily replaceable stabilizer having features adapted to counteract both the steering torque phenomenon and for substantially eliminating porpoising of the boat, and which can be easily manufactured in a number of different forms to accommodate varying use patterns.

The present invention meets this need and therefore solves the foregoing and other problems long associated with high performance boats using outboard motors through provision of a stabilizer adapted to effect steering torque compensation and for substantially eliminating porpoising, which can be adjustably mounted due to the need for a trim tab adjustment, and easily interchangeable with other such devices of varying size so that the optimum stabilizing effect can be achieved.

SUMMARY OF THE INVENTION

In accordance with a preferred form of the present invention, a stabilizer is disclosed which is adapted for use with a boat having an outboard motor employing an anti-cavitation plate having a generally horizontal lower surface vertically above a propeller driven by the motor. A support is detachably attached on the lower surface of the anti-cavitation plate, the attachment providing for adjustable movement of the support in a plane generally parallel to the lower surface. A generally vertical fin-shaped member extends downwardly from the support and has laterally facing side surfaces for being positioned in response to movement of the support and for receiving a force imparted by moving water in contact with the side surfaces to induce a torque in counteraction to a torque induced by rotation of the propeller in the water. A generally horizontally oriented wedge-shaped member extends rearwardly from the support and has a lower, generally planar surface, downwardly inclined relative to the anti-cavitation plate whereby movement of the boat through the water imparts a force against the downwardly inclined surface to induce a torque on the boat to substantially eliminate porpoising of the boat as the boat moves through the water.

In accordance with another aspect of the invention, the angle of attack of the downwardly inclined surface increases when the bow of the boat is moved up, and decreases when the bow of the boat moves down, and the force imparted against the downwardly inclined surface increases proportionately with an increase in the angle of attack of said surface, whereby upward movement of the bow of the boat is opposed by a proportionately greater force exerted against the downwardly inclined surface.

The advantages and further aspects of the present invention will be readily appreciated by those of ordinary skill in the art as the same becomes better understood by reference to the following detailed description when considered in conjunction with the accompanied drawings in which:

DESCRIPTION OF THE PREFERRED EMBODIMENTS

Figure 1:
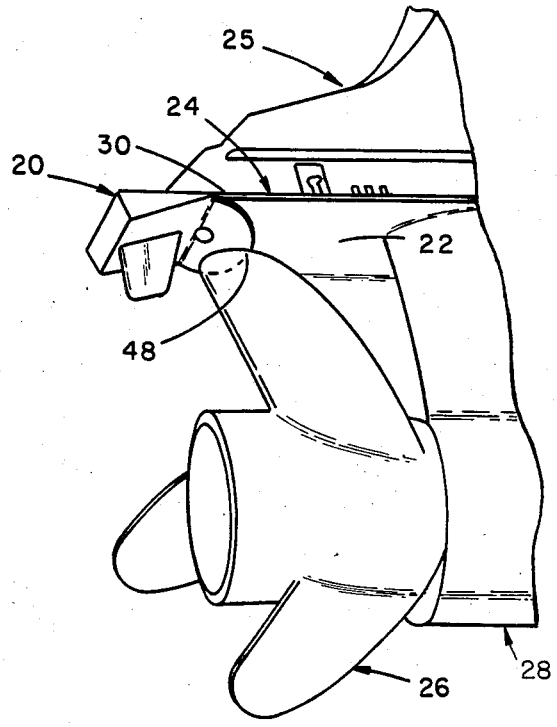
FIG. 1 is a perspective view of one embodiment of the invention showing a stabilizer detachably attached to the rearward part of the lower surface of an anti-cavitation plate, generally above and behind the propeller of an outboard motor.

Referring now to the drawings in which like reference characters refer to like or similar parts throughout the several views, there is shown in FIG. 1 a stabilizer 20 detachably attached to a lower surface 22 of an anti-cavitation plate 24 located generally vertically above a propeller 26 of a conventional outboard motor 28. Movement of the boat (not shown) through the water is induced by rotation of the propeller 26 in a conventional manner, so that as the boat moves through the water, there exists what can be referred to as a flow of water past the anti-cavitation plate 24 to contact the surface of the stabilizer 20. In a known manner, the lower surface 22 of the anti-cavitation plate 24 minimizes the possibility that air may be drawn from the surface into the water surrounding the propeller 26 which will reduce propeller thrust. Thus, the function of the anti-cavitation plate 24 is not disturbed or altered by the presence of the stabilizer 20 according to the illustration of FIG. 1. The presence of the stabilizer 20 at a rearward end 30 of the anti-cavitation plate 24 is effective to induce a torque on the outboard motor 28 to compensate for steering torque in a manner to be described, and is effective to cause a generally vertical torque on the boat to substantially eliminate porpoising of the boat as the boat moves through the water.

Figure 2:
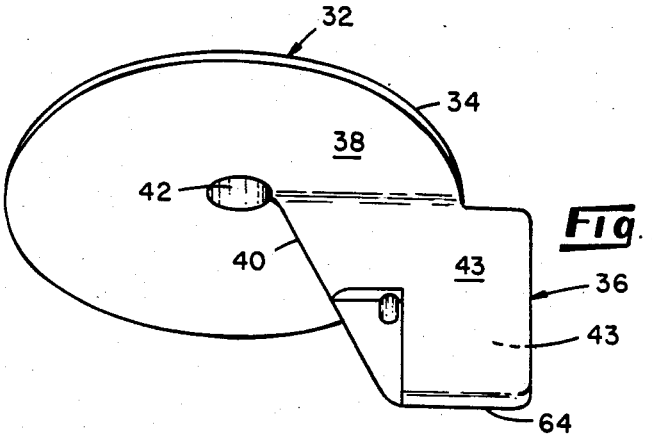
Fig. 2 PRIOR ART
FIG. 2 is a perspective view of a trim tab constructed generally according to the prior art devices illustrating a fin-shaped member extending generally vertically downward from the surface of a disk-shaped support which can be adjustably and detachably attached to the anti-cavitation plate.

Referring now to FIG. 2, one form of a conventional-type trim tab 32 is illustrated comprising the support 34 in the shape of a relatively thin disk. A fin-shaped member 36 (hereinafter referred to as fin member 36) extends generally perpendicularly from a lower surface 38 of the support 34. When the trim tab 32 is mounted on the lower surface 22 of the anti-cavitation plate 24 as shown in FIG. 1, the fin member 36 is considered extending vertically downwardly generally from the lower surface 38 of the support 34. A leading front edge 40 slopes downwardly from the approximate center of the support 32 in a rearward direction according to a common feature of structure exposed to a moving stream of fluid to minimize flow restrictions caused by the presence of the structure, the flow being considered moving in a left to right direction in FIGS. 2 and 3. An opening 42 in the approximate center of the support 34 receives a fastener of some type, such as a bolt or screw which can be tightened to hold the trim tab 32 in a desired orientation, and loosened to permit adjustment or replacement of the trim tab 32. A pair of laterally facing surfaces 43 on opposite sides of the fin member 36 are positioned in response to movement of the support 34 and receive a force imparted by moving water in contact with the side surfaces 43 to induce a torque in counteraction to a torque induced by rotation of the propeller 26 in the water. The shape of the support 34 permits easy adjustment of the orientation of the fin member 36 by loosening the trim tab 32 and rotating the support 34 in a recessed portion 48 of the anti-cavitation plate 24 to alter the degree to which the fin member 36 counteracts steering torque caused by rotation of the propeller 26 as described above.

In ordinary use, a trim tab 32 such as shown in FIG. 2 is positioned within a recessed portion of the lower surface 22 of the anti-cavitation plate 24 such as the recess 48. The depth of the recess 48 is approximately equal to the thickness of the support 34 so that the support 34 is substantially flush with the lower surface 22 of the anti-cavitation plate 24.

Figure 3:
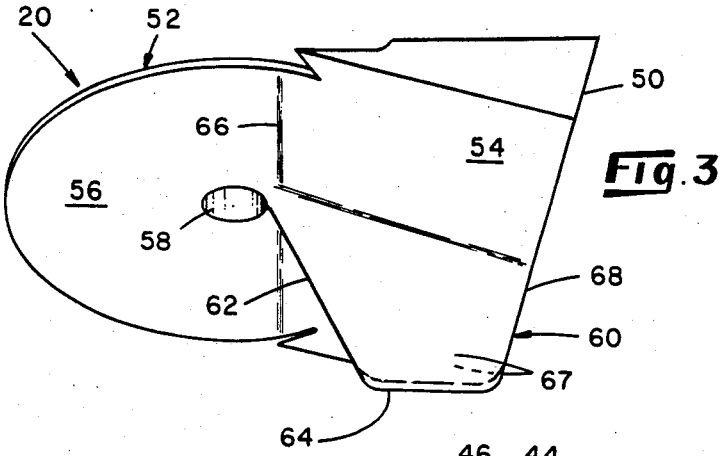
FIG. 3 is a perspective view of a preferred form of the stabilizer illustrating a wedge-shaped member extending rearwardly of the support and laterally of the fin shaped member.

Referring now to FIGS. 3 through 8, various views of a preferred form of the stabilizer 20 are shown. The perspective view of FIG. 3 shows a wedge-shaped member 50 (hereinafter referred to as wedge member 50) extending rearwardly from a support 52. The wedge member 50 has a lower generally planer surface 54 downwardly inclined relative to a lower surface 56 of the support 52. The support 52 is disk-shaped as is the support 34 of the conventional trim tab 32 shown in FIG. 2, and has substantially the same diameter and thickness so that the support 52 will fit within the recessed portion 48 of the anti-cavitation plate 24. As described more fully below, movement of the boat through the water imparts a force against the downwardly inclined surface 54 to effect a generally vertical torque on the boat to substantially eliminate porpoising of the boat as the boat moves through the water.

An opening 58 in the approximate center of the support 52 receives a bolt in a manner similar to that described above relative to FIG. 2 for providing easy removal of the stabilizer 20, and for permitting adjustment of the orientation of a fin-shaped member 60 (hereinafter referred to as fin member 60) extending generally perpendicularly from the inclined surface 54. Comparing FIGS. 2 and 3, it is seen that the fin member 60 has a leading edge 62 inclined at approximately the same angle as the leading edge 40 of the fin member 36 of the conventional trim tab 32. A lower tip portion 64 is also substantially the same vertical distance from the lower planar surface 56 of the support 52 as is a lower tip portion 66 of the fin member 36 shown in FIG. 2. Thus, comparatively speaking, the fin member 60 will produce substantially the same reaction to the flow of water against a pair of laterally facing surfaces 67 on opposite sides of the fin member 60 as described above relative to the conventional trim tab 32. However, the existence of the wedge member 50 extending laterally from the fin member 60 reduces the surface area of the fin member 60 available to be impacted by the flow of water, which may have some slight effect on the steering torque compensation of the fin member 60.

Figure 8:
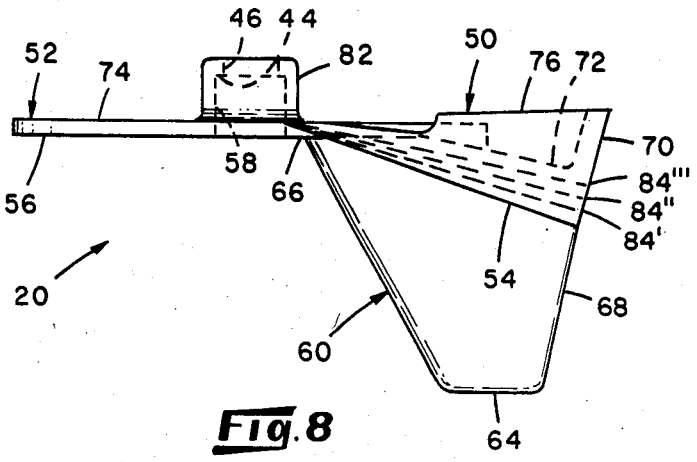
FIG. 8 is a side view of the stabilizer shown in FIGS. 3 through 7.

Comparing FIGS. 3 and 8, it is seen that the inclined surface 54 has a forward, preferably linear edge 66 where the inclined surface 54 meets the lower surface 56 of the support 52. The inclined surface 54 makes an approximately 18 degree angle with the lower surface 56 of the support 52 in this embodiment of the stabilizer 20, this being an angle which has been found preferable in substantially eliminating porpoising with some outboard motor/hull combinations. Also of note is the fact that a rearward or trailing edge 68 of the fin member 60 makes approximately the same angle with the lower surface 56 as does a trailing or rearward surface 70 of the wedge member 50, the angle being about 10 to 14 degrees. It has been found that having the trailing surface 70 of the stabilizer 20 angled in this manner minimizes flow disturbances which may be caused by the presence of the wedge member 50 in the flow path of water moving past the stabilizer 20.

Figure 4:
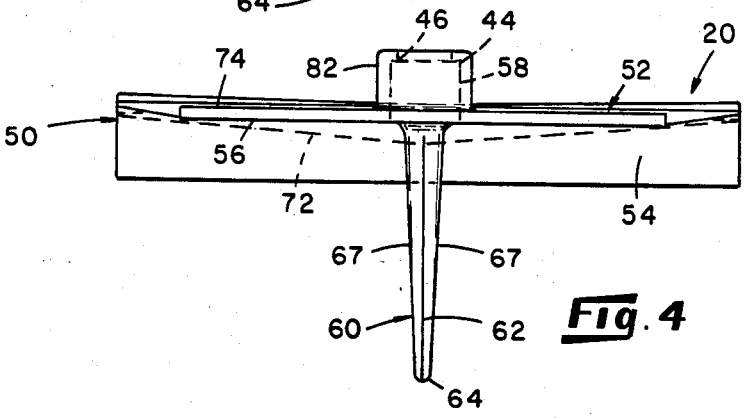
FIG. 4 is a front view of the stabilizer shown in FIG. 3.
Figure 5:
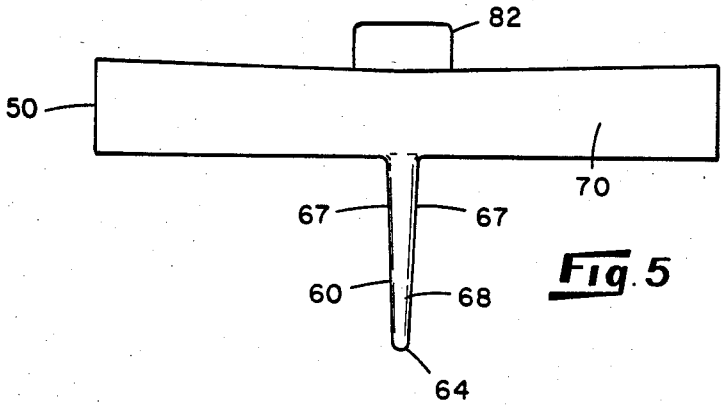
FIG. 5 is a rear view of the stabilizer shown in FIGS. 3 and 4.
Figure 6:
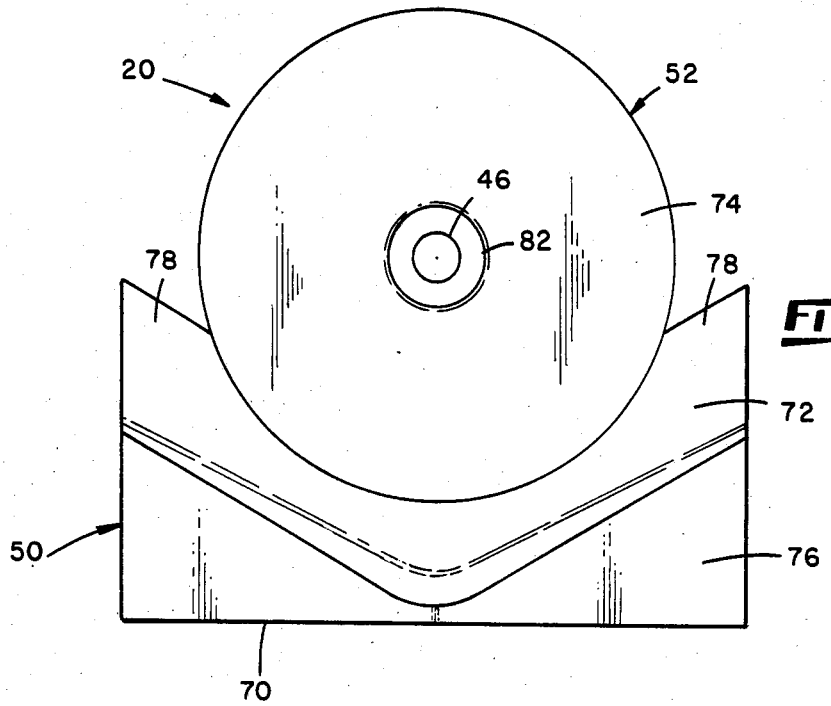
FIG. 6 is a top view of the stabilizer of FIGS. 3 through 5.

Referring now to FIGS. 4, 6 and 8, a depressed area 72 is shown formed between an upper surface 74 of the support and an upper surface 76 of the wedge member 50. The shape of the depressed area 72 is dictated generally by the form of the trailing end 30 of the anti-cavitation plate 24 so that the rearward upper surface 76 of the stabilizer is substantially coplanar with the upper surface (not shown) of the anti-cavitation plate 24. This insures a relatively undisturbed flow of water across the upper surface of the anti-cavitation plate 24 when the stabilizer 20 is used.

Figure 7:
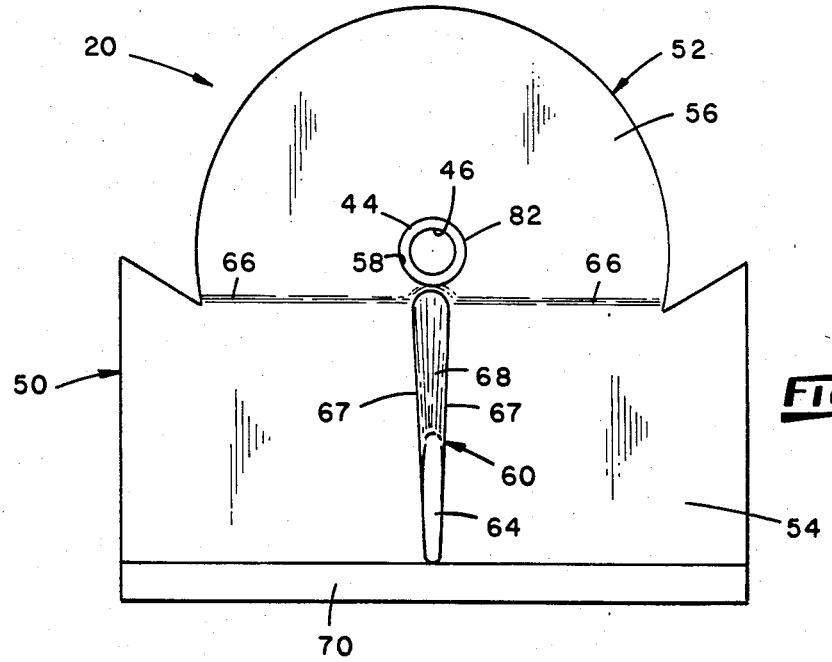
FIG. 7 is a bottom view of the stabilizer shown in FIGS. 3 through 6.

Referring to FIGS. 3, 6 and 7, there are shown wing-like portions 78 extending laterally from opposite sides of the support 52. These portions, like the depressed area 72, are dictated by the particular design of the anti-cavitation plate 24 and necessitated by the fact that the inclined surface 54 along its laterally outermost ends extends generally to the plane made by the upper surface 74 of the support 52 as shown in FIG. 8.

Also shown in FIGS. 4 through 8 is a neck portion 82 protruding upwardly from the approximate center of the upper surface 74 of the support 52. The opening 42 extends from the lower side 56 of the support 52 into a portion of the neck 82 as described above. The neck 82 also serves as a guide for placing the stabilizer 20 in the recessed area 48, an opening (not shown) being formed in the recessed portion 48 complementary of the neck 82 and having in its approximate center a threaded bore for receiving the bolt used to attach the stabilizer 20 to the outboard motor 28. Preferably, as shown in FIG. 4, the opening 58 is countersunk so that an annular ledge 44 exists at the bottom of the opening 58 where there is defined a more narrow opening 46 dimensioned to receive the bolt. The head of the bolt is tightened against the annular ledge 44 to hold the stabilizer 20 in place. Ordinarily, the bolt used has a head portion adapted to be tightened and loosened by an Allen wrench.

It is to be noted that the stabilizer 20 can be formed with a variety of different angles of the inclined surface 54 relative to the lower surface 22 of the anti-cavitation plate 24. For the purposes of illustration, several dashed lines 84', 84'', and 84''' are shown in FIG. 8 illustrating alternate inclined surfaces of 15 degrees, 12½ degrees and 10 degrees relative to the lower surface 22 of the anti-cavitation plate 24.

These angles can change depending on a number of factors including water temperature, speed or rate of acceleration, the load carried by the boat, various weather conditions and so forth. Also, some boating enthusiasts have adopted the practice of changing outboard motors from one boat to another, with slight hull variations in the boats necessitating unexpected adjustment of compensating features employed at the stern of the boat. Thus, having a number of the stabilizers 20 on hand with varying angles being employed for the inclined surface 54 makes it possible to substantially eliminate porpoising of the boat in practically any situation. Generally, angles of the inclined surface 54 in the range of 10 to 45 degrees have been found advantageous, depending on the circumstances in which the stabilizer 20 is used.

It will be further appreciated that removal of a stabilizer having one angular disposition of the inclined surface 54, and replacement with another stabilizer 20 having a different angular disposition of the inclined surface 54 to adjust for a change in conditions can be easily accomplished by raising the outboard motor 28, loosening the bolt holding the stabilizer 20 on the anti-cavitation plate 24, and replacing the stabilizer 20 with the one having a different angular disposition of the inclined surface 54. In this manner, a stabilizer 20 which has the greatest effect on eliminating porpoising can be selected for ultimate use under the particular conditions. I should also be appreciated that once the stabilizer 20 is tightened on the anti-cavitation plate 24, it is not likely to be broken off or otherwise moved from its position as is likely with other devices that have been used to effect a lift at the stern of a boat such as the adjustable trim vane disclosed in U.S. Pat. No. 3,980,035 to Johansson where the trim vane is mounted directly in the propeller slip stream, and therefore is subject to being damaged or broken off by objects near the surface of the water. Also, the stabilizer 20 is not subject to being moved by vibration of the motor 28 or flopping up and down in the water current as is likely with a device such as the one shown in Johansson's patent. It is also clear that the stabilizer is not subject to a mechanical failure as is the case with a hydraulically controlled, adjustable trim vane. It is also easier to make, and is mechanically simple, with no moving parts.

Figure 9:
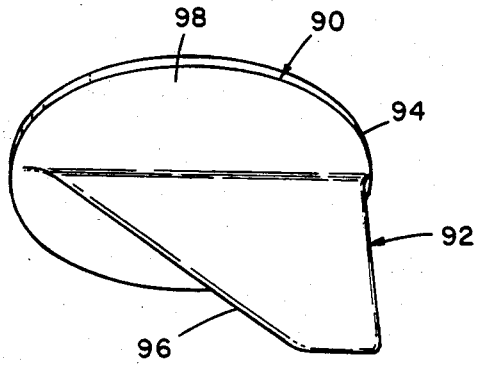
Fig. 9 PRIOR ART
FIG. 9 is a perspective view of another form of trim tab according to the prior art.
Figure 10:
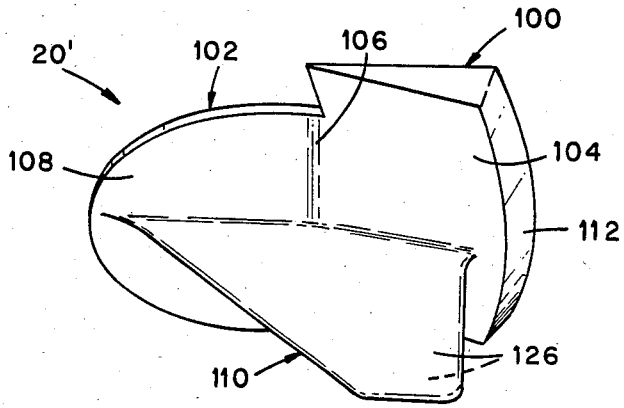
FIG. 10 is an alternate embodiment of the stabilizer shown in FIG. 3 adapted for being used with outboard motors using trim tabs such as the one illustrated in FIG. 9, showing a wedge-shaped member extending rearwardly of the support with a curved lateral edge.

Referring now to FIG. 9, another type of trim tab 90 is shown resembling the trim tab 32 of FIG. 2, except for the extension of a fin-shaped member 92 (hereinafter referred to as fin member 92) generally across the circumference of a disk-shaped support 94. A leading edge 96 of the fin member 92 makes a more acute angle with a lower surface 98 of the support 94 than the leading edge 40 of the trim tab 32 which is dictated by the type of outboard motor on which the trim tab 90 is used. The trim tab 90 functions in essentially the same manner as the other form of the trim tab 32, notwithstanding its modified shape.

Referring now to FIGS. 10 through 15, an alternate form of the stabilizer 20' is shown particularly adapted for use with an outboard motor requiring a trim tab 90 of the type shown in FIG. 9. Comparing FIGS. 10 and 3, it is seen that the stabilizer 20' includes essentially the same features as the stabilizer 20 described above. A wedge-shaped member 100 (hereinafter referred to as wedge member 100) extends rearwardly from near the center of a disk-shaped support 102, a downwardly inclined surface 104 being formed on the lower part of the wedge member 100 with a line of intersection 106 between the inclined surface 104 and a lower surface 108 of the support 102. A fin-shaped member 110 (hereinafter referred to as fin member 110) extends generally perpendicularly from the support 102 and from the approximate center of the inclined surface 104 of the wedge member 100. Approximately equal areas of the downwardly inclined surface 104 extends laterally from opposite sides of the fin member 110 as with the stabilizer 20 of FIG. 3 whereby forces imparted against the inclined surface 104 are of substantially equal magnitude on both sides of the inclined surface 104. Comparing FIGS. 9 and 10, it is seen that the fin member 110 is formed to assume approximately the same configuration as the fin member 92 of the trim tab 90, with the exception of slightly decreased surface area of the fin member 110 due to formation of the wedge member 110 on the support 102. The wedge member 110 of this embodiment has an arcuate trailing or rearward surface 112 to mate with the shape of the trailing edge of the anti-cavitation plate 24 for which this form of the stabilizer 20' is designed. As shown in FIGS. 11 through 13, and FIG. 15, the stabilizer 20' has a neck 114 protruding from the approximate center of an upper surface 116 of the support 102. The neck 114 functions essentially the same as the neck 82 on the other embodiment discussed above, with the exception being that an opening 118 in the neck 114 does not pass completely through the stabilizer 20' as do the openings 58 and 46 in the stabilizer 20. Essentially, the opening 118 is a bore having female threads formed on its inner surface for mating with a bolt extending from the approximate center of the recessed portion 48 of the lower surface 22 of the anti-cavitation plate 24 (anti-cavitation plate 24 of FIG. 1 being modified accordingly). Ordinarily, the bolt is accessible from an upper portion (not shown) of the anti-cavitation plate 24 for being tightened to hold the stabilizer 20' on the anti-cavitation plate 24. The orientation of the stabilizer 20' is adjusted by loosening the bolt, permitting rotation of the stabilizer 20' in the recessed portion 48 generally in the manner described above, except that the degree of rotation is limited by a square abutting portion 120 of the neck 114 extending generally forwardly of the opening 118. The abutting portion 120 extends into an additional recess (not shown) in the recessed portion 48, the additional recess having a fan-shaped configuration for permitting limited rotation of the stabilizer 20' through a predetermined arc.

Figure 11:
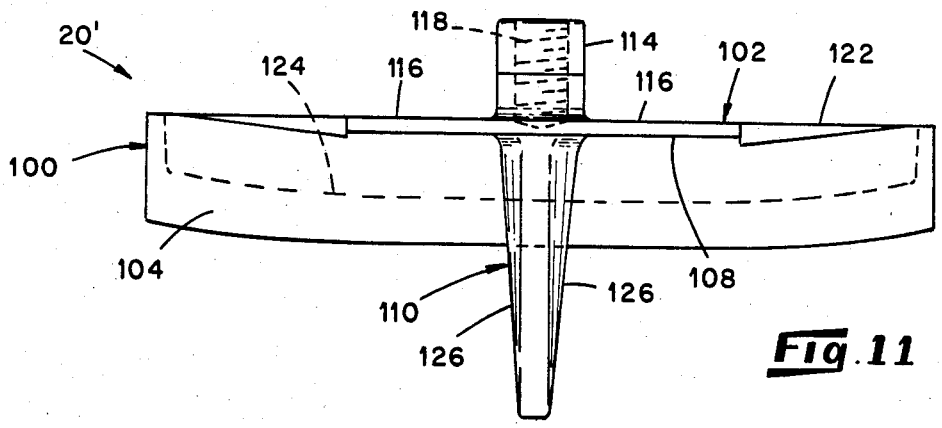
FIG. 11 is a front view of the stabilizer shown in FIG. 10.
Figure 12:
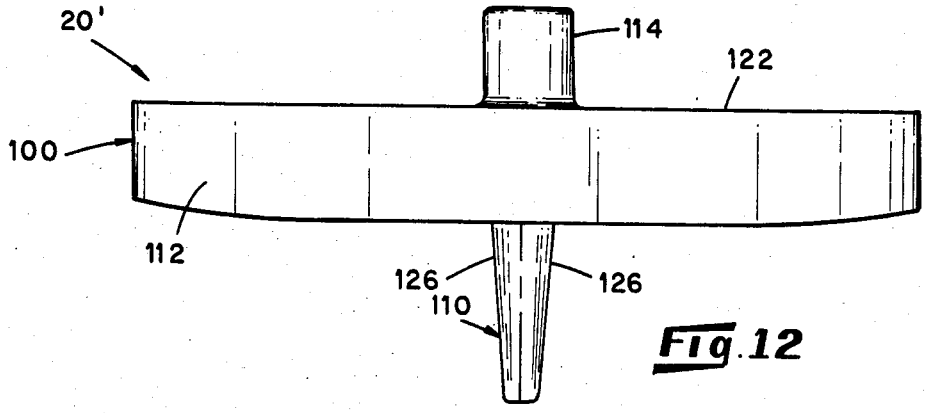
FIG. 12 is a rear view of the stabilizer shown in FIGS. 10 and 11.
Figure 13:
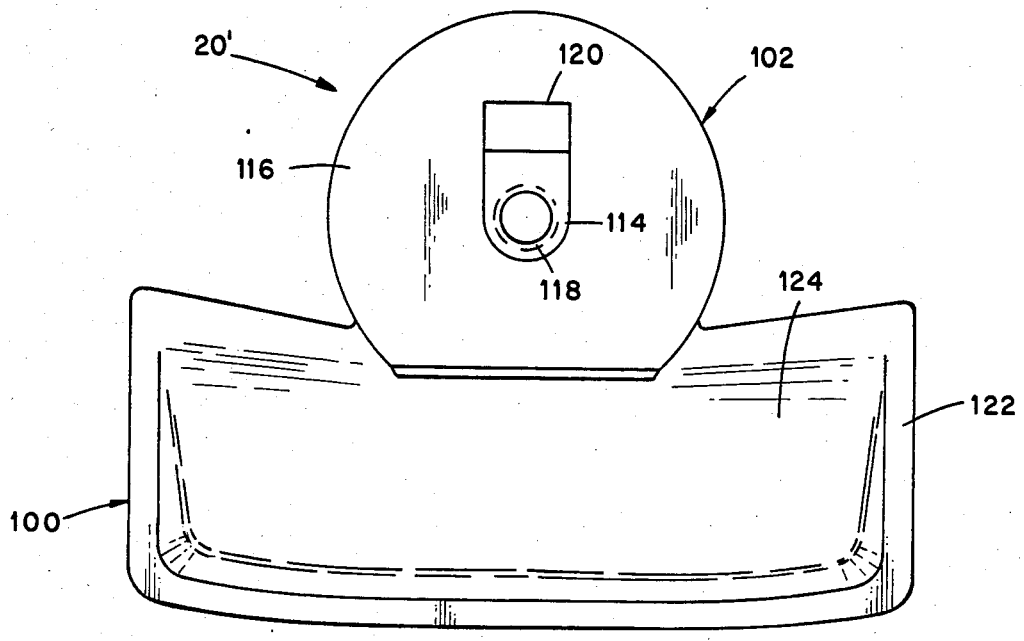
FIG. 13 is a top view of the stabilizer shown in FIGS. 10 through 12.
Figure 15:
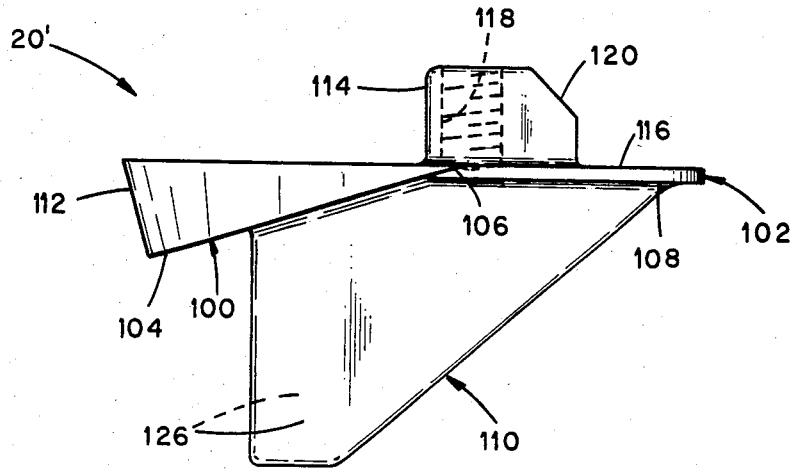
FIG. 15 is a side view of the stabilizer shown in FIGS. 10 through 14.

As shown in FIGS. 11, 12 and 15, an upper surface 122 of the wedge member 100 is substantially coplaner with the upper surface 116 of the support 102. This permits the wedge member 100 to be in contact with the lower surface of the anti-cavitation plate since the recessed portion 48 ordinarily extends to the back edge of the anti-cavitation plate 24. A depressed area 124 of the wedge member 100 is formed when the stabilizer 20' is cast, it not being necessary in most cases to have the wedge member 100 as a solid. When the stabilizer 20' is attached to the anti-cavitation plate 24, the depressed area 124 will be hidden since the upper surface 122 of the stabilizer 20' is flush with the lower surface of the anti-cavitation plate 24.

Figure 14:
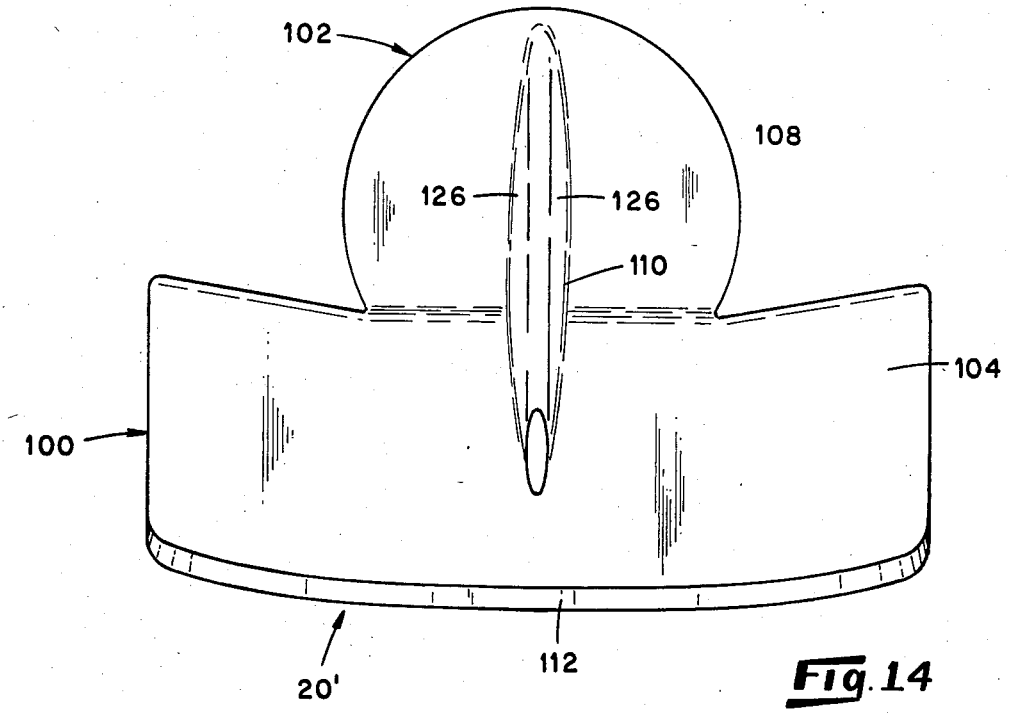
FIG. 14 is a bottom view of the stabilizer shown in FIGS. 10 through 13.

An additional aspect of the pesent invention involves concentrating the force inducing the torque at the area of the inclined surface adjacent lateral sides of the fin member 110. For example, as shown in FIGS. 10 through 12 and FIG. 14, it is seen that according to general principals of fluid dynamics, the water flowing along opposite lateral faces 126 of the fin member 110 will move at a higher velocity than the water passing over the lateral extensions of the inclined surfaces 104. This is due to the foil-shape of the fin member 110 as seen in FIG. 14. This relatively higher velocity water flowing adjacent the lateral faces 126 imparts a relatively greater force on the area of the inclined surface 104 surrounding the fin member 110. In this manner, the fin member 110 and wedge member 100 cooperate to produce a force on the inclined surface 104 which is essentially equal to the force that would be imparted on the surface 104 if the fin member 110 did not extend from the surface 104, with the added benefit of having the fin member 110 and wedge member 100 incorporated into a single device which can be removed and replaced with another stabilizer having an inclined surface 104 angled or shaped differently as described above, and adjusted to alter the orientation of the fin member 110 to counteract steering torque.

Another advantage of having the fin members 60 and 110 incorporated with the wedge members 50 and 100 involves the effect of the stabilizers 20 and 20', respectively, during turns. It is known that boats porpoise during turns, and the stabilizers 20 and 20' have been found to reduce or eliminate porpoising during turns as well. It is believed that this is due to the presence of the fin members 60 and 110 along the surfaces 54 and 104. Thus, when the boat is turning, water which would otherwise "slide" across the surface 54 and 104 diagonally is directed to move, along at least one side of the surfaces 54 and 104, more parallel to the fin members 60 and 110 so that the force against the surfaces 54 and 104 is not substantially diminished during turns.

It should also be appreciated that the angle of attack of the downwardly inclined surfaces 54 and 104 increases when the bow of the boat is moved up, and decreases when the bow of the boat moves down, and the force imparted against the downwardly inclined surfaces 54 and 104 increases proportionately with an increase in the angle of attack of the surfaces 54 and 104, whereby upward movement of the bow of the boat is opposed by a proportionately greater force exerted against the downwardly inclined surfaces 54 and 104. In this respect, it is to be appreciated that while the stabilizers 20 and 20' do reduce or eliminate porpoising, they also function in a manner which is essentially self-regulating in that their effect is greater when the tendancy of the boat to porpoise is greater.

Although particular embodiments of the boat stabilizer have been described in the foregoing detailed description, it will be understood that the stabilizer is capable of numerous modifications and rearrangements without departing from the scope of the invention as set forth in the claims below.

What is claimed is:

1. A boat stabilizer adapted for use with a boat having an outboard motor employing an anti-cavitation plate having a generally horizontal lower surface vertically above a propeller driven by the motor, the stabilizer comprising:

a support detachably attached to the lower surface of the anti-cavitation plate, the attachment providing for adjustable movement of said support in a plane generally parallel to the lower surface;

a generally vertical fin-shaped member extending downwardly from said support and having laterally facing side surfaces for being positioned in response to movement of said support and for receiving a force imparted by moving water in contact with said side surfaces to induce a torque in counteraction to a torque induced by rotation of the propeller in the water; and a generally horizontally oriented wedge-shaped member formed on said support and extending rearwardly from said support, said member having a lower, generally planar surface, downwardly inclined relative to said anti-cavitation plate, whereby movement of the boat through the water imparts a force against said downwardly inclined surface to induce a torque on said boat substantially eliminating porpoising of the boat as the boat moves through the water.

2. A boat stabilizer adapted for use with a boat having an outboard motor employing an anti-cavitation plate having a generally horizontal lower surface vertically above a propeller driven by the motor, the stabilizer comprising:

a support detachably attached to the lower surface of the anti-cavitation plate, the attachment providing for adjustable movement of said support in a plane generally parallel to the lower surface;

a generally vertical fin-shaped member extending downwardly from said support and having laterally facing side surfaces for being positioned in response to movement of said support and for receiving a force imparted by moving water in contact with said side surfaces to induce a torque in counteraction to a torque induced by rotation of the propeller in the water; and a generally horizontally oriented wedge-shaped member extending rearwardly from said support and having a lower, generally planar surface, downwardly inclined relative to said anti-cavitation plate, said downwardly inclined surface extending from a generally planar lower surface of said support, the line of intersection of said downwardly inclined surface with said lower surface of said support being substantially linear, whereby movement of the boat through the water imparts a force against said downwardly inclined surface to induce a torque on said boat substantially eliminating porpoising of the boat as the boat moves through the water.

3. A boat stabilizer adapted for use with a boat having an outboard motor employing an anti-cavitation plate having a generally horizontal lower surface vertically above a propeller driven by the motor, the stabilizer comprising:

a support detachably attached to the lower surface of the anti-cavitation plate, the attachment providing for adjustable movement of said support in a plane generally parallel to the lower surface;

a generally vertical fin-shaped member extending downwardly from said support and having laterally facing side surfaces for being positioned in response to movement of said support and for receiving a force imparted by moving water in contact with said side surfaces to induce a torque in counteraction to a torque induced by rotation of the propeller in the water; and a generally horizontally oriented wedge-shaped member extending rearwardly from said support and having a lower, generally planar surface, downwardly inclined relative to said anti-cavitation plate, said support being formed in the shape of a disc, with said downwardly inclined surface extending from adjacent the approximate center of said support, and said fin member having a downwardly inclined leading edge at an acute angle relative to said downwardly inclined surface and extending from adjacent the approximate center of said support, whereby movement of the boat through the water imparts a force against said downwardly inclined surface to induce a torque on said boat substantially eliminating porpoising of the boat as the boat moves through the water.

4. A boat stabilizer adapted for use with a boat having an outboard motor employing an anti-cavitation plate having a generally horizontal lower surface vertically above a propeller driven by the motor, the stabilizer comprising:

a support detachably attached to the lower surface of the anti-cavitation plate, the attachment providing for adjustable movement of said support in a plane generally parallel to the lower surface;

a generally vertical fin-shaped member extending downwardly from said support and having laterally facing side surfaces for being positioned in response to movement of said support and for receiving a force imparted by moving water in contact with said side surfaces to induce a torque in counteraction to a torque induced by rotation of the propeller in the water; and a generally horizontally oriented wedge-shaped member extending rearwardly from said support and having a lower, generally planar surface, downwardly inclined relative to said anti-cavitation plate, said downwardly inclined surface intersecting said laterally facing side surfaces of said fin member in a plane generally perpendicular to the plane of said fin member, whereby movement of the boat through the water imparts a force against said downwardly inclined surface to induce a torque on said boat substantially eliminating porpoising of the boat as the boat moves through the water.

5. The boat stabilizer of claim 4, wherein said downwardly inclined surface comprises a first lateral surface extending from one of said side surfaces of said fin member, and a second lateral surface substantially equal in surface area to that of said first lateral surface extending from the other of said side surfaces of said fin member, whereby forces imparted against said downwardly inclined surface are of substantially equal magnitude on said first lateral surface and said second lateral surface.

6. A boat stabilizer adapted for use with a boat having an outboard motor employing an anti-cavitation plate having a generally horizontal lower surface vertically above a propeller driven by the motor, the stabilizer comprising:

a support detachably attached to the lower surface of the anti-cavitation plate, the attachment providing for adjustable movement of said support in a plane generally parallel to the lower surface;

a generally vertical fin-shaped member extending downwardly from said support and having laterally facing side surfaces for being positioned in response to movement of said support and for receiving a force imparted by moving water in contact with said side surfaces to induce a torque in counteraction to a torque induced by rotation of the propeller in the water; and a generally horizontally oriented wedge-shaped member extending rearwardly from said support and having a lower, generally planar surface, downwardly inclined relative to said anti-cavitation plate, said downwardly inclined surface comprising a first lateral surface extending from one of said side surfaces of said fin member, and a second lateral surface substantially equal in surface area to that of said first lateral surface extending from the other of said side surfaces of said fin member, whereby movement of the boat through the water imparts a force against said downwardly inclined surface to induce a torque on said boat substantially eliminating porpoising of the boat as the boat moves through the water and forces imparted against said downwardly inclined surface are of substantially equal magnitude on said first lateral surface and said second lateral surface.

7. The boat stabilizer of claim 6, wherein said wedge member has a rearward surface extending laterally across said wedge member with said rearward surface being generally perpendicular to said downwardly inclined surface.

8. The boat stabilizer of claim 7, wherein said rearward surface has a generally arcuate shape.

9. The boat stabilizer of claim 7, wherein said rearward surface has a generally planar surface.

10. The boat stabilizer of claim 1, wherein the angle of attack of said downwardly inclined surface increases when the bow of the boat moves up, and decreases when the bow of the boat moves down, and the force imparted against said downwardly inclined surface increases proportionately with an increase in the angle of attack of said surface, whereby upward movement of the bow of the boat is opposed by a proportionately greater force exerted against the downwardly inclined surface.

* * * * *